US012297723B2

(12) United States Patent
Brown

(10) Patent No.: US 12,297,723 B2
(45) Date of Patent: May 13, 2025

(54) ELECTRIC CLOSING SIDE POCKET MANDREL

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/136,791

(22) Filed: Apr. 19, 2023

(65) Prior Publication Data

US 2024/0352836 A1 Oct. 24, 2024

(51) Int. Cl.
*E21B 43/12* (2006.01)
*E21B 23/03* (2006.01)

(52) U.S. Cl.
CPC ..... *E21B 43/123* (2013.01); *E21B 23/03* (2013.01)

(58) Field of Classification Search
CPC .. E21B 43/123; E21B 34/066; E21B 43/1235; E21B 21/103; E21B 43/122
See application file for complete search history.

(56) References Cited

U.S. PATENT DOCUMENTS 2,649,272 A 8/1953 Barbato
2,845,940 A 8/1958 Garrett et al.
2,942,671 A 6/1960 Josephine
3,160,113 A 12/1964 Meyers
3,630,640 A 12/1971 McMurry et al.
3,646,953 A 3/1972 Elliott et al.
3,654,949 A 4/1972 McMurry
3,863,961 A 2/1975 Dinning
3,874,445 A 4/1975 Terral
3,888,273 A 6/1975 Douglas
4,033,409 A 7/1977 Hebert
4,035,103 A 7/1977 McMurry et al.
4,135,576 A 1/1979 Tausch
(Continued)

FOREIGN PATENT DOCUMENTS

EP 2666957 A2 11/2013
WO WO-0155553 A1 * 8/2001 ..... E21B 17/003
(Continued)

OTHER PUBLICATIONS

English translation of BR 102021017557. (Year: 2023).*
(Continued)

*Primary Examiner* — Zakiya W Bates
(74) *Attorney, Agent, or Firm* — Baker Hughes Patent Organization

(57) ABSTRACT

A side pocket mandrel is configured for use within a gas lift system deployed in a well that has an annular space surrounding the gas lift system. The side pocket mandrel includes a central body that includes a central bore, a gas lift valve pocket, and a gas lift valve installed within the gas lift valve pocket. The side pocket mandrel may also include a motorized choke valve assembly to selectively cover some or all of an internal tubing port extending between the central bore and the gas lift valve pocket. The side pocket mandrel may also include an automatic closing valve assembly configured to automatically close the gas lift valve port when the gas lift valve is removed from the side pocket mandrel.

15 Claims, 4 Drawing Sheets

(56) References Cited

U.S. PATENT DOCUMENTS

| | | | |
|---|---|---|---|
| 4,146,091 | A | 3/1979 | Terral |
| 4,265,306 | A | 5/1981 | Stout |
| 4,295,795 | A | 10/1981 | Gass et al. |
| 4,295,796 | A | 10/1981 | Moore |
| 4,333,527 | A | 6/1982 | Higgins et al. |
| 4,437,487 | A | 3/1984 | Marmon |
| 4,505,331 | A | 3/1985 | Akkerman |
| RE32,441 | E | 6/1987 | Higgins et al. |
| 4,685,523 | A | 8/1987 | Paschal et al. |
| 4,722,393 | A | 2/1988 | Rumbaugh |
| 4,759,410 | A | 7/1988 | Benker et al. |
| 5,033,550 | A | 7/1991 | Johnson et al. |
| 5,176,164 | A | 1/1993 | Boyle |
| 5,181,566 | A | 1/1993 | Barneck |
| 5,535,767 | A | 7/1996 | Schnatzmeyer et al. |
| 5,597,042 | A | 1/1997 | Tubel et al. |
| 5,971,004 | A | 10/1999 | Pringle |
| 6,070,608 | A | 6/2000 | Pringle |
| 6,082,455 | A | 7/2000 | Pringle et al. |
| 6,148,843 | A | 11/2000 | Pringle |
| 6,206,645 | B1 | 3/2001 | Pringle |
| 6,241,015 | B1 | 6/2001 | Pringle et al. |
| 6,321,842 | B1 | 11/2001 | Pringle et al. |
| 6,352,109 | B1 | 3/2002 | Buckman |
| 6,375,155 | B1 | 4/2002 | Janssens |
| 6,679,332 | B2 | 1/2004 | Vinegar et al. |
| 6,715,550 | B2 | 4/2004 | Vinegar et al. |
| 6,722,632 | B2 | 4/2004 | Kenny et al. |
| 7,213,607 | B2 | 5/2007 | De |
| 7,228,909 | B2 | 6/2007 | Schmidt et al. |
| 7,658,229 | B2 | 2/2010 | Becker et al. |
| 7,770,637 | B2 | 8/2010 | Phloi-Montri et al. |
| 7,793,727 | B2 | 9/2010 | Gaudette |
| 8,162,060 | B2 | 4/2012 | Randazzo |
| 8,251,147 | B2 | 8/2012 | Mondelli et al. |
| 8,453,736 | B2 | 6/2013 | Constantine |
| 8,714,264 | B2 | 5/2014 | Fay |
| 8,881,825 | B2 | 11/2014 | White et al. |
| 9,057,243 | B2 | 6/2015 | Hendel et al. |
| 9,453,397 | B2 | 9/2016 | Dowling et al. |
| 9,453,398 | B1 | 9/2016 | Zhang et al. |
| 9,587,463 | B2 | 3/2017 | Tveiten et al. |
| 10,655,439 | B2 | 5/2020 | Murdoch et al. |
| 10,677,028 | B2 | 6/2020 | Oliphant |
| 10,787,889 | B2 | 9/2020 | Salihbegovic et al. |
| 10,830,012 | B2 | 11/2020 | Holmes et al. |
| 11,578,569 | B2 | 2/2023 | Rodger |
| 11,851,988 | B2 | 12/2023 | Newton et al. |
| 2001/0017157 | A1 | 8/2001 | Pringle |
| 2002/0020533 | A1 | 2/2002 | Tubel |
| 2002/0029883 | A1 | 3/2002 | Vinegar et al. |
| 2003/0164240 | A1 | 9/2003 | Vinegar et al. |
| 2006/0137881 | A1 | 6/2006 | Schmidt et al. |
| 2007/0181312 | A1 | 8/2007 | Kritzler et al. |
| 2007/0227739 | A1 | 10/2007 | Becker et al. |
| 2009/0056952 | A1 | 3/2009 | Churchill |
| 2011/0036591 | A1 | 2/2011 | George et al. |
| 2011/0083855 | A1 | 4/2011 | Wygnanski |
| 2012/0292034 | A1 | 11/2012 | Fay |
| 2013/0146155 | A1 | 6/2013 | Gilbertson et al. |
| 2013/0220599 | A1 | 8/2013 | Rae |
| 2013/0220628 | A1 | 8/2013 | Tran |
| 2014/0352982 | A1 | 12/2014 | White et al. |
| 2016/0290099 | A1 | 10/2016 | Balasubramanian |
| 2020/0011155 | A1 | 1/2020 | Stamm et al. |
| 2020/0032592 | A1 | 1/2020 | Romer et al. |
| 2020/0256144 | A1 | 8/2020 | Deville et al. |
| 2022/0186587 | A1 | 6/2022 | Newton et al. |
| 2022/0220834 | A1 | 7/2022 | Brown et al. |
| 2023/0041355 | A1 | 2/2023 | Brown et al. |
| 2023/0116200 | A1 | 4/2023 | Guest |
| 2024/0052730 | A1 | 2/2024 | Balasubramanian et al. |

FOREIGN PATENT DOCUMENTS

| | | | |
|---|---|---|---|
| WO | 2004031529 | A2 | 4/2004 |
| WO | 2014022121 | A1 | 2/2014 |
| WO | 2016049726 | A1 | 4/2016 |
| WO | 2020212726 | A1 | 10/2020 |
| WO | 2022173815 | A1 | 8/2022 |

OTHER PUBLICATIONS

Botil; Gas Lift Equipment Catalogue; www.botilindia.com; date unknown.

"MMRG Series Side Pocket Mandrels", Schlumberger, MMRG Series Side Pocket Mandrels, Sales Brochure, 2015.

"Side Pocket Mandrels", Parveen Industries Pvt. Ltd., Side Pocket Mandrels; www.parveen.in/products/side-pocket-mandrels; webpage captured Jul. 29, 2022.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

Schnatzmeyer, M.A. , et al., "Development of a Surface-Controlled Electric Gas-Lift Valve", Journal of Petroleum Technology, May 1, 1994, May 1, 1994.

ISA/US; International Search Report and Written Opinion for PCT/US2024/025287 mailed Sep. 17, 2024.

* cited by examiner

ELECTRIC CLOSING SIDE POCKET MANDREL

FIELD OF THE INVENTION

This invention relates generally to the field of oil and gas production, and more particularly to a gas lift system that incorporates an improved gas lift module.

BACKGROUND

Gas lift is a technique in which pressurized gaseous fluids are used to reduce the density of the produced fluids to allow the formation pressure to push the less dense mixture to the surface. In annulus-to-tubing systems, pressurized gases are injected from the surface into the annulus, where the pressurized gases enter the tubing string through a series of gas lift valves. Alternatively, in tubing-to-annulus systems, pressurized gases are injected into the tubing string and discharged into the annulus, where the gases help to produce fluids out of the annulus.

The gas lift valves can be configured to automatically open when the pressure gradient between the annulus and the production tubing exceeds the closing force holding each gas lift valve in a closed position. In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open at a threshold pressure, thereby injecting pressurized gases into the production tubing or the annulus.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

A common problem in gas lift completions is the management of interventions required to accommodate unforeseen well operations. For example, while setting packers and testing tubing by increasing the pressure within the annulus, "dummy" valves are typically installed within the side pocket mandrels to prevent flow of completion fluids from the annulus into the production tubing, or from the production tubing into the annulus. Once the packers have been set, the dummy valves are replaced with types of gas lift valves that permit flow into the production string from the annulus.

As another example, when it becomes necessary to unload the well, the gas lift valves must be closed as the fluid level in the well drops to prevent the gas within the annulus from escaping through an open gas lift valve. This requires operators to plan the unloading sequence and valve parameters for a specific well given a set of assumed production parameters within the well. Because the operation of gas lift valves cannot be easily adjusted once the gas lift valves have been installed, typical gas lift systems cannot be easily adapted to changing production parameters within the well.

Moreover, there is a growing market for electric completions and a desire to electrify gas lift systems, with an option for continuing to use traditional gas lift valves that can be retrieved using conventional wireline-based systems. There is, therefore, a need for an improved gas lift system that overcomes these and other deficiencies in the prior art.

SUMMARY OF THE INVENTION

In one aspect, embodiments of the present disclosure are directed to a side pocket mandrel for use within a gas lift system deployed in a well that has an annulus surrounding the gas lift system. In this embodiment, the side pocket mandrel includes a central body that includes a central bore, a gas lift valve pocket that is laterally offset from the central body, a gas lift valve installed within the gas lift valve pocket, and an electric valve assembly. The electric valve assembly includes a lateral valve chamber, an exterior port connecting the lateral valve chamber to the annulus, an interior port connecting the lateral valve chamber to the gas lift valve pocket, a valve member configured to selectively prevent the passage of fluid through the lateral valve chamber, and an actuator configured to drive the valve member.

In another aspect, embodiments of the present disclosure are directed to a side pocket mandrel for use within a gas lift system deployed in a well that has an annulus surrounding the gas lift system. The side pocket mandrel has a central body that includes a central bore, a gas lift valve pocket that is laterally offset from the central body, and a gas lift valve installed within the gas lift valve pocket. The side pocket mandrel further includes a first electric valve assembly that has a first lateral valve chamber, a first exterior port connecting the first lateral valve chamber to the annulus, a first interior port connecting the first lateral valve chamber to the gas lift valve pocket, a first valve member configured to selectively prevent the passage of fluid through the first lateral valve chamber, and a first actuator configured to drive the first valve member. The side pocket mandrel also includes a second electric valve assembly that has a second lateral valve chamber, a second exterior port connecting the second lateral valve chamber to the annulus, a second interior port connecting the second lateral valve chamber to the gas lift valve pocket, a second valve member configured to selectively prevent the passage of fluid through the second lateral valve chamber, and a second actuator configured to drive the second valve member.

In yet another aspect, embodiments of the present disclosure are directed to a method of servicing a gas lift system deployed in a well that has an annulus surrounding the gas lift system, where the gas lift system includes a side pocket mandrel with a central body, a gas lift valve pocket, and a gas lift valve installed in the gas lift valve pocket. The method includes the steps of actuating an electric valve assembly in the side pocket mandrel to isolate the gas lift valve pocket from the annulus, and removing the gas lift valve with a wireline-based tool.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells. References to "lateral" positions should be interpreted as laterally offset from an axis or component extending in a substantially vertical orientation.

Figure 1:
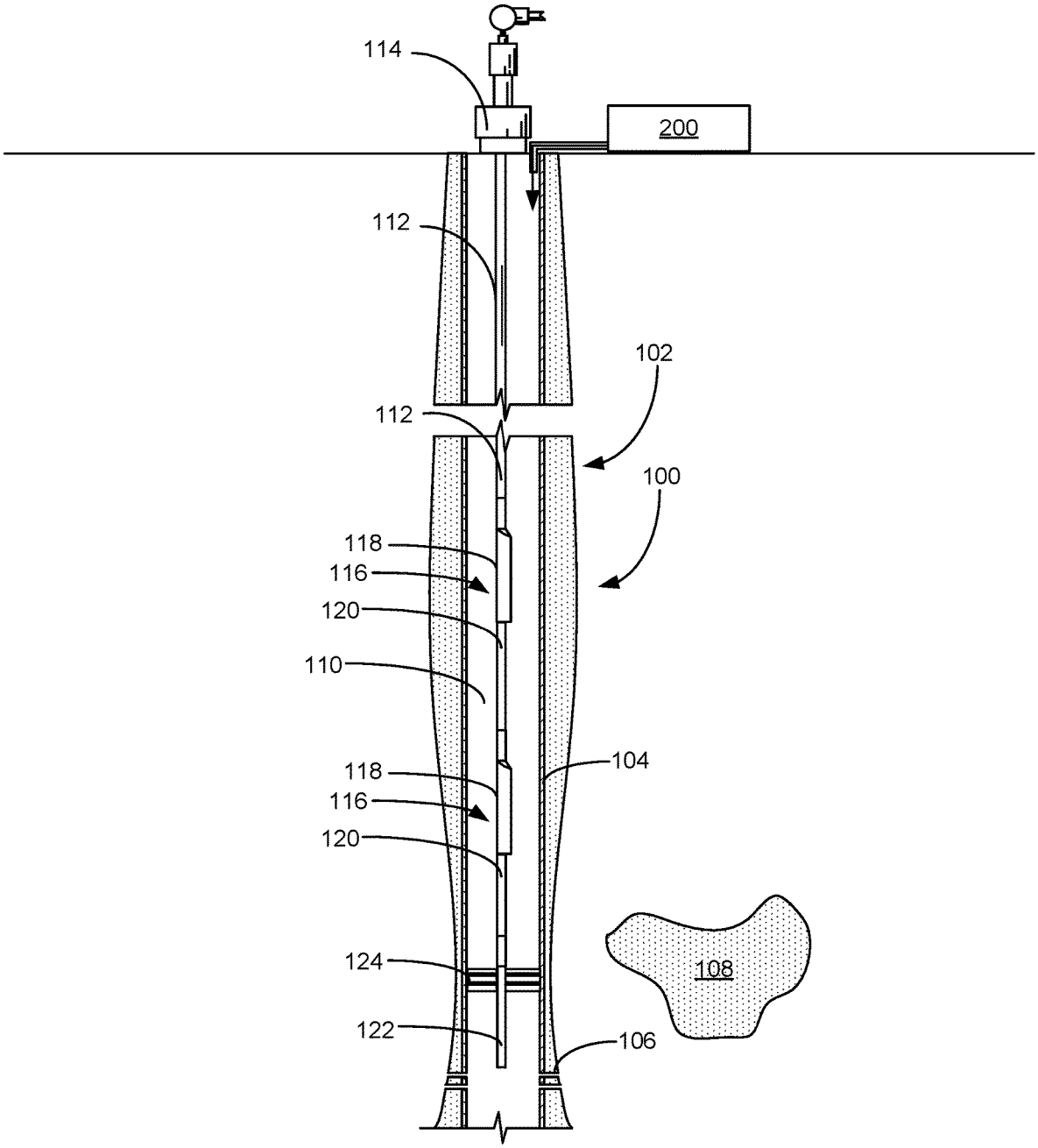
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annulus 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from a gas supply 200 on the surface into the annulus 110 surrounding the gas lift system 100. When the pressure gradient between the annulus 110 and the interior of the production tubing 112 exceeds a threshold value, the gas lift modules 116 admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

Figure 2:
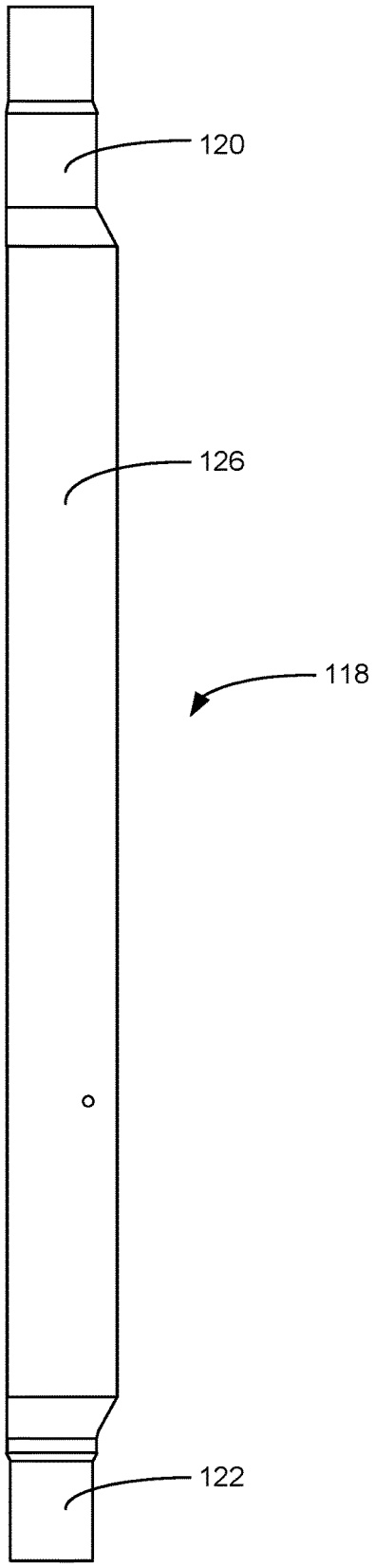
FIG. 2 is a side view of a side pocket mandrel constructed in accordance with an embodiment of the invention.
Figure 3:
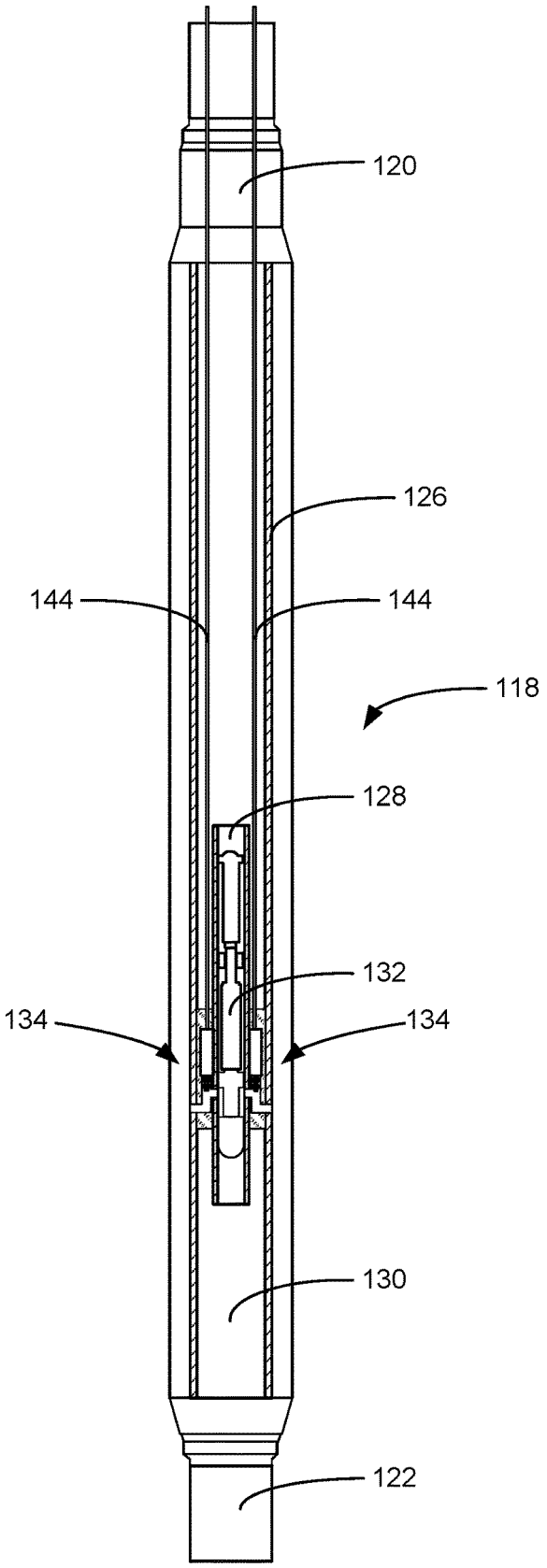
FIG. 3 is a side cross-sectional view of the side pocket mandrel, gas lift valve, and electric valve assemblies.

Turning to FIGS. 2-3, shown therein are side and partial cross-sectional depictions of the gas lift module 116. The side pocket mandrel 118 includes a central body 126 and a gas lift valve pocket 128 within the side pocket mandrel 118. The central body 126 includes a central bore 130. The gas lift valve pocket 128 laterally offset and separated from the central bore 130, which extends in a substantially colinear fashion with the inlet pipe 122 and pup joint 120. The side pocket mandrel 118 includes a gas lift valve 132 within the gas lift valve pocket 128.

The side pocket mandrel 118 includes one or more electric valve assemblies 134 that controllably permit or prohibit the passage of fluid between the annulus 110 and the valve pocket 128. Although two electric valve assemblies 134 are depicted, it will be appreciated that some embodiments include the use of a single electric valve assembly 134, while other embodiments include the use of three of more electric valve assemblies 134.

Turning to FIGS. 4-8, shown therein are close-up cross-sectional views of the electric valve assemblies 134, the gas lift valve pocket 128 and the gas lift valve 132. Each electric valve assembly 134 includes an actuator 136 and a valve member 138. In the embodiments depicted in FIGS. 4-8, the valve member 138 includes an extensible piston 140 driven by the actuator 136. In exemplary embodiments, the actuator 136 is configured to controllably deploy and retract the valve member 138 within a lateral valve chamber 142. As depicted, the electric valve assemblies 134 are positioned in generally opposite sides of the gas lift valve pocket 128. Given the circular or oval cross-section of the side pocket mandrel 118, it will be appreciated that the electric valve assemblies 134 may not be located in a common plane with the gas lift valve pocket 128.

Power and control signals are provided to the actuator 136 through a suitable conductor 144, such as a tubing encapsulated conductor (TEC) line. In some embodiments, the actuator 136 is a solenoid or other linear actuator that drives the valve member 138 back and forth. In other embodiments, the actuator 136 is a screw-type motor that advances or retracts a threaded member to advance or retract the valve member 138. In other embodiments, the valve member 138 includes a rotary valve element with passages that only permit flow through the lateral valve chamber 142 when the passages are rotated into alignment with passages in a second valve member.

Figure 4:
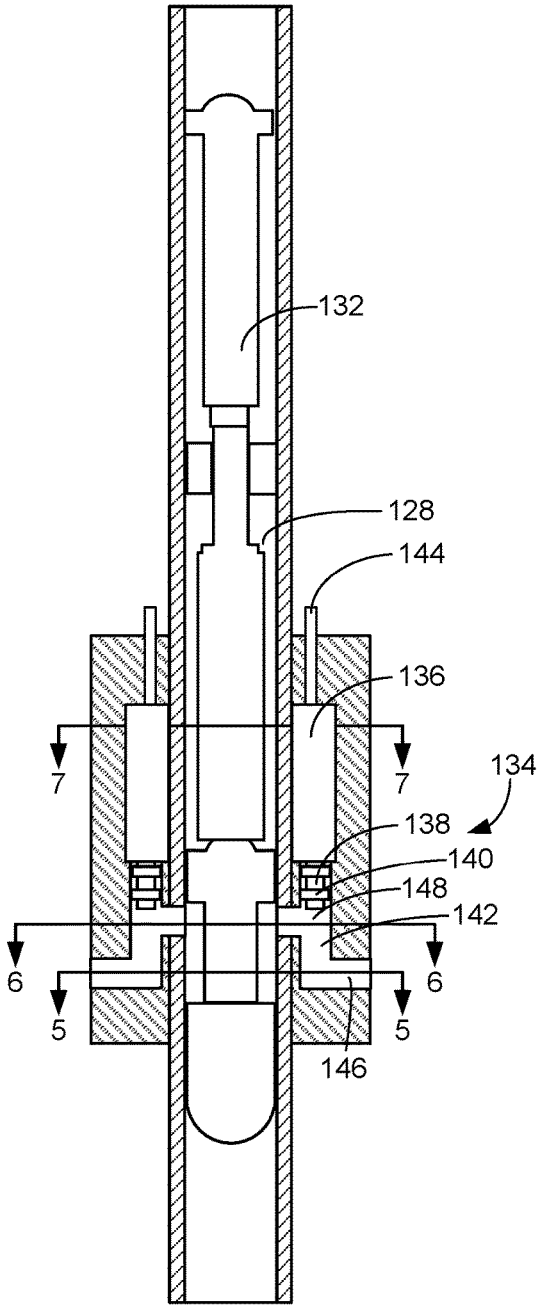
FIG. 4 is a close-up cross-sectional view of the gas lift valve, valve pocket, and the electric valve assemblies in an open position.
Figure 8:
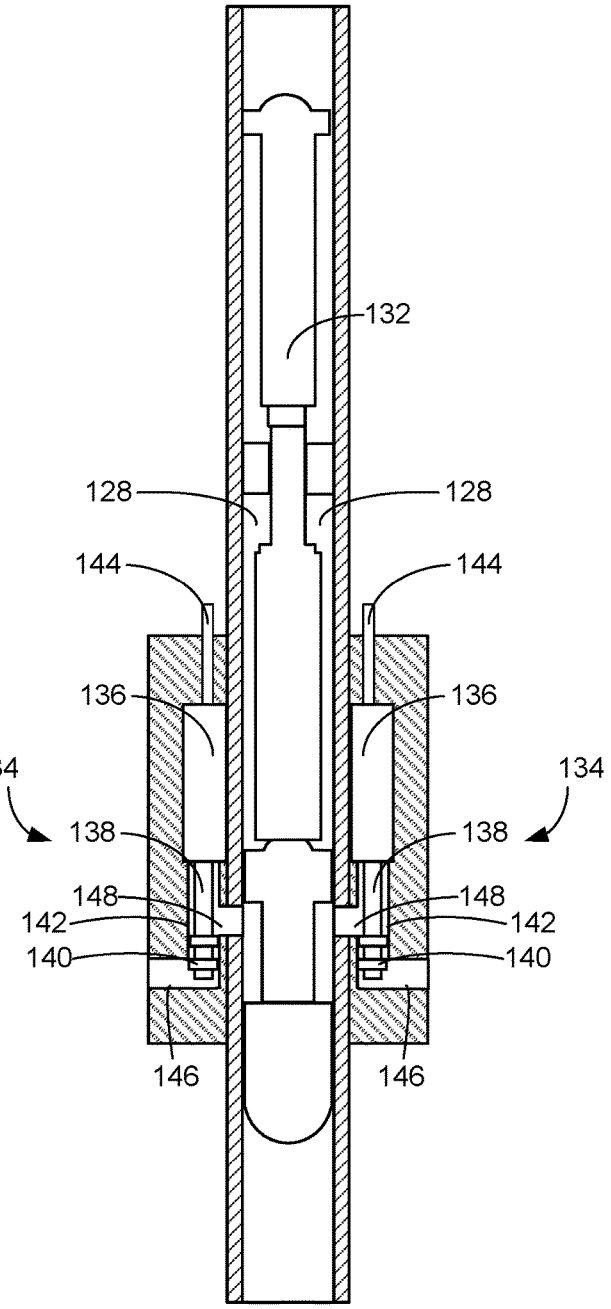
FIG. 8 is a close-up cross-sectional view of the gas lift valve, valve pocket, and the electric valve assemblies in a closed position.
Figure 5:
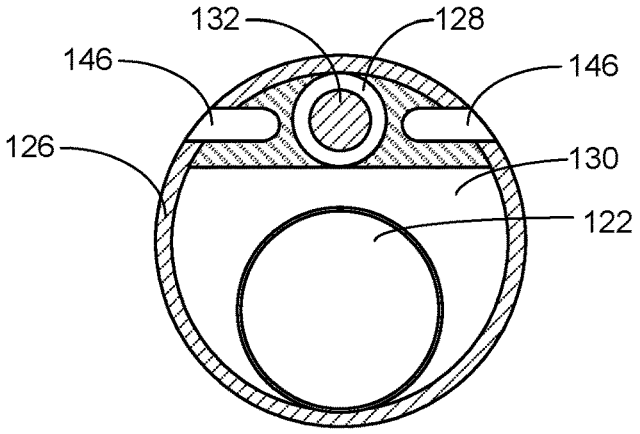
FIG. 5 is a transverse cross-sectional view of the side pocket mandrel illustrating the connection from the exterior ports to the corresponding lateral valve chambers.
Figure 6:
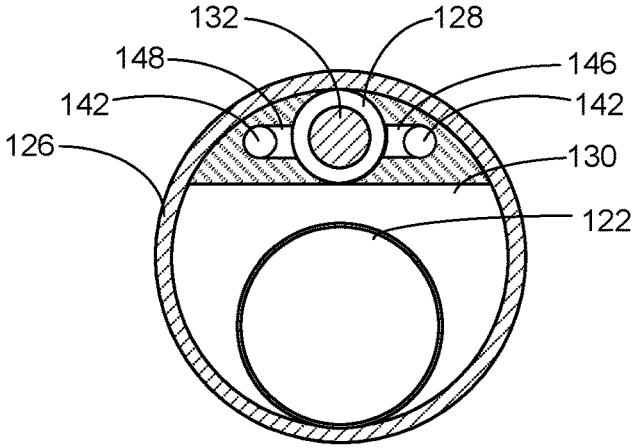
FIG. 6 is a transverse cross-sectional view of the side pocket mandrel illustrating the connection between the lateral valve chambers, the interior ports and the valve pocket.
Figure 7:
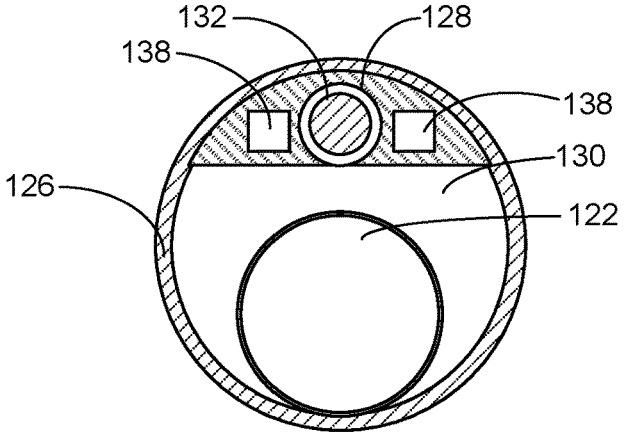
FIG. 7 is a transverse cross-sectional view of the side pocket mandrel illustrating an embodiment in which the valve actuators are located in a laterally offset position relative to the gas lift valve pocket.

As best illustrated in FIGS. 4 and 8, each lateral valve chamber 142 is connected to the annulus 110 through an exterior port 146. Each lateral valve chamber 142 is connected to the gas lift valve pocket 128 through an interior port 148. The exterior port 146 is located at an opposite end of the lateral valve chamber 142 from the interior port 148. It will be appreciated that in other embodiments, the exterior port 146 is located closer to the actuator 136 and the interior port 148 is located at the opposite end of the lateral valve chamber 142.

The extensible piston 140 is sized to fully occlude the lateral valve chamber 142, thereby preventing flow through the lateral valve chamber 142 when the extensible piston 140 is deployed. As illustrated in FIG. 8, deploying the extensible piston 140 into a position between the exterior port 146 and interior port 148 prevents the passage of fluid between the exterior and interior ports 146, 148, thereby isolating the gas lift valve pocket 128 from the annulus 110. Retracting the extensible piston 140 into a portion of the lateral valve chamber 142 between the interior port 148 and the actuator 136 permits the passage of fluid from the annulus 110 to the gas lift valve pocket 128, as illustrated in FIG. 4. When the electric valve assembly 134 is in the "open" state, the gas lift valve 132 controls the passage of fluids from the gas lift valve pocket 128 into the central bore 130. When the pressure in the annulus 110 exceeds the threshold opening pressure for the gas lift valve 132, the fluid passes through the gas lift valve 132 into the central bore 130.

During normal operation of the gas lift module 116, the electric valve assemblies 134 are placed in the "open" state depicted in FIG. 4. In this position, the gas lift valve 132 regulates the passage of fluid from the annulus 110 into the central bore 130. If, however, it becomes necessary to remove the gas lift valve 132 while isolating the central bore 130 from fluid in the annulus 110, the electric valve assemblies 134 can be placed in the "closed" state depicted in FIG. 8. The electric valve assemblies 134 therefore provide an effective mechanism for closing the side pocket mandrel 118 while permitting the retrieval and installation of the gas lift valve 132 using conventional wireline and kickover tools.

Although the embodiment depicted in FIGS. 4-8 has been illustrated and described in connection with an annulus-to-tubing system, the same embodiment can also be used in connection with a tubing-to-annulus system in which pressurized gas is injected into the production tubing 112 and discharged through the gas lift module 116 into the annulus 110. The electric valve assembly 134 may find particular utility in tubing-to-annulus applications in which the gas lift valve 132 has been removed from an upper side pocket mandrel 118 and where it is desirable to prevent the passage of pressurized gas into the annulus 110 through the upper side pocket mandrel 118 so the gas can be directed to a lower side pocket mandrel 118.

The ability to selectively enable and disable the gas lift valve 132 with the electric valve assembly 134 significantly improves the versatility of the gas lift system 100 by allowing the operator to respond to a condition in which preventing the flow of fluids between the gas lift valve pocket 128 and the central bore 130 is desirable. For example, while the well 102 is being unloaded of excess fluid in the annulus 110, the electric valve assemblies 134 can be activated to selectively disable the gas lift valve 132 in a gas lift module 116 that is no longer under the liquid level in the annulus 110. Without the ability to selectively disable the gas lift valve 132 within the gas lift module 116, pressure within the annulus 110 would tend to escape through the "dry" gas lift module 116, thereby decreasing the efficiency of the unloading operation. In this way, the electric valve assemblies 134 enable the operator to only open those gas lift modules 116 that are useful in unloading the well 102.

Moreover, the electric valve assemblies 134 permit the selective isolation of the gas lift valve 132 from the annulus 110 with an electric on-demand system, while still permitting the retrieval and installation of the gas lift valve 132 using conventional wireline-based tools (including standard kickover tools). In this way, the embodiments disclosed herein can be configured for use in a method for servicing the gas lift system 100 by actuating the electric valve assembly 134 in the side pocket mandrel 118 to isolate the gas lift valve pocket 128 from the annulus 110, and then removing the gas lift valve 132 with a wireline-based tool. The method can further include installing a second gas lift valve into the gas lift valve pocket 128 with a wireline-based tool before placing the gas lift valve pocket 128 into fluid communication with the annulus 110 by placing the valve member 138 in an open position with the actuator 136.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use within a gas lift system deployed in a well that has an annulus surrounding the gas lift system, the side pocket mandrel comprising:
- a central body that includes a central bore;
- a gas lift valve pocket that is laterally offset from the central body;
- a gas lift valve installed within the gas lift valve pocket; and
- an electric valve assembly, wherein the electric valve assembly comprises:
  - a lateral valve chamber located to the side of the gas lift valve pocket;
    - an exterior port connecting the lateral valve chamber to the annulus;
    - an interior port connecting the lateral valve chamber to the gas lift valve pocket;
    - a valve member configured to selectively prevent the passage of fluid through the lateral valve chamber; and
    - an actuator configured to drive the valve member.

2. The side pocket mandrel of claim 1, wherein the valve member comprises an extensible piston.

3. The side pocket mandrel of claim 2, wherein the actuator is an electric motor.

4. The side pocket mandrel of claim 3, wherein the actuator is a solenoid.

5. A side pocket mandrel for use within a gas lift system deployed in a well that has an annulus surrounding the gas lift system, the side pocket mandrel comprising:
- a central body that includes a central bore;
- a gas lift valve pocket that is laterally offset from the central body;
- a gas lift valve installed within the gas lift valve pocket;
- a first electric valve assembly, wherein the first electric valve assembly comprises:
  - a first lateral valve chamber located on a first side of the gas lift valve pocket;
    - a first exterior port connecting the first lateral valve chamber to the annulus;
  - a first interior port connecting the first lateral valve chamber to the gas lift valve pocket;
    - a first valve member configured to selectively prevent the passage of fluid through the first lateral valve chamber; and
    - a first actuator configured to drive the first valve member; and
- a second electric valve assembly, wherein the second electric valve assembly comprises:
  - a second lateral valve chamber located on a second side of the gas lift valve pocket;
    - a second exterior port connecting the second lateral valve chamber to the annulus;
    - a second interior port connecting the second lateral valve chamber to the gas lift valve pocket;

a second valve member configured to selectively prevent the passage of fluid through the second lateral valve chamber; and a second actuator configured to drive the second valve member.

6. The side pocket mandrel of claim 5, wherein the first valve member comprises an extensible piston.

7. The side pocket mandrel of claim 6, wherein the first actuator is an electric motor.

8. The side pocket mandrel of claim 7, wherein the first actuator is a solenoid.

9. The side pocket mandrel of claim 5, wherein the second valve member comprises an extensible piston.

10. The side pocket mandrel of claim 9, wherein the second actuator is an electric motor.

11. The side pocket mandrel of claim 10, wherein the second actuator is a solenoid.

12. The side pocket mandrel of claim 5, wherein the first interior port and the second interior port intersect the gas lift valve pocket on opposite sides of the gas lift valve pocket.

13. The side pocket mandrel of claim 5, wherein the first interior port is located between the first actuator and the first exterior port.

14. The side pocket mandrel of claim 5, wherein the second interior port is located between the second actuator and the second exterior port.

15. The side pocket mandrel of claim 5, wherein the gas lift valve is configured to be retrieved from the gas lift valve pocket using a wireline-based tool.

* * * * *